US006380680B1

(12) United States Patent
Troxler

(10) Patent No.: US 6,380,680 B1
(45) Date of Patent: Apr. 30, 2002

(54) ELECTRODELESS GAS DISCHARGE LAMP ASSEMBLY WITH FLUX CONCENTRATOR

(75) Inventor: John E. Troxler, Logansport, IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/165,976

(22) Filed: Oct. 2, 1998

(51) Int. Cl.[7] ..... H01J 65/04
(52) U.S. Cl. ..... 313/607; 313/234
(58) Field of Search ..... 313/18, 21, 30, 313/40, 42, 44, 46, 160, 161, 234, 485, 607, 613, 318.01; 315/248, 112, 57, 80, 82; 362/226, 263, 265

(56) References Cited

U.S. PATENT DOCUMENTS

| | | | | | |
|---|---|---|---|---|---|
| 2,287,607 | A | * | 6/1942 | Farnsworth | 313/57 |
| 2,947,901 | A | * | 8/1960 | Haddad | 315/57 |
| 2,974,243 | A | * | 3/1961 | Marrison | 313/46 |
| 3,950,670 | A | * | 4/1976 | Hruda | 315/344 |
| 4,000,432 | A | | 12/1976 | Coon | |
| 4,152,745 | A | | 5/1979 | Eul | |
| 4,561,489 | A | | 12/1985 | Dantzig | |
| 4,797,595 | A | | 1/1989 | Dejong | |
| 4,902,937 | A | | 2/1990 | Witting | |
| 5,027,041 | A | | 6/1991 | Godyak | |
| 5,276,419 | A | | 1/1994 | Griffin | |
| 5,529,747 | A | | 6/1996 | Learman | |
| 5,539,283 | A | | 7/1996 | Piejak | |
| 5,621,266 | A | | 4/1997 | Popov et al. | |
| 5,630,958 | A | | 5/1997 | Stewart | |
| 5,698,951 | A | * | 12/1997 | Maya et al. | 315/248 |
| 5,723,941 | A | | 3/1998 | Roelevink | |
| 5,723,947 | A | * | 3/1998 | Popov et al. | 313/634 |
| 6,087,774 | A | * | 7/2000 | Nakayama et al. | 33/607 |
| 6,118,226 | A | * | 9/2000 | Kohne et al. | 315/248 |

* cited by examiner

*Primary Examiner*—Michael H. Day
(74) *Attorney, Agent, or Firm*—Reising, Ethington, Barnes, Kisselle, Learman & McCulloch, P.C.

(57) ABSTRACT

An inductively driven gas discharge lamp assembly (20,40) which includes an electrodeless lamp (12,12'), an inductive drive coil (14), and a flux concentrator (22,42) disposed about the drive coil. The drive coil (14) is wound about the lamp (12,12'), which has a neon or other ionizable gas fill that provides a visible plasma discharge upon energization by the drive coil. The flux concentrator (22,42) can comprise a sleeve (24,44) of magnetically permeable material, such as ferrite, which confines the magnetic field generated by the drive coil (14). The flux concentrator (42) can include an end piece (46) that further confines the magnetic field at one end of the drive coil and c include a core piece (48) that extends into a central recess (50) within the lamp (12') to concentrate the magnetic flux at a particular region within the lamp where the plasma discharge is primarily located. Also disclosed is an automotive lamp assembly (60) that incorporates the flux concentrator (22) along with an d.c. to a.c. inverter circuit (64), an r.f. shield (80), and a heat sink (106).

6 Claims, 2 Drawing Sheets

ELECTRODELESS GAS DISCHARGE LAMP ASSEMBLY WITH FLUX CONCENTRATOR

BACKGROUND OF THE INVENTION

1. Field of the Invention

This invention relates in general to electrodeless gas discharge lamps and, in particular, to drive circuits for such lamps that use alternating magnetic fields to produce a plasma discharge in the lamps.

2. Description of the Related Art

Radio frequency drive circuits for electrodeless gas discharge lamps sometimes utilize an inductive drive coil to produce a plasma discharge within the lamp envelope. Alternating current flow through the coil generates an alternating magnetic field that impinges on the ionizable gas fill within the lamp, thereby producing the plasma discharge. These drive coils may be helically wound about the lamp envelope, as in U.S. Pat. No. 4,902,937 to Witting. Alternatively, the lamp envelope may include a central recessed portion within which the drive coil is located, as in U.S. Pat. No. 4,797,595 to De Jong. As shown in the De Jong patent, the drive coil can be wound around a magnetically permeable core which has the effect of increasing the inductance of the drive coil.

In applications such as automotive vehicle lights where operating power comes from a battery, it is desirable to minimize the power used to operate the lamps. However, external vehicle lights such as tail lights must produce sufficient intensity to accommodate the various ambient lighting conditions that can be encountered in normal use. Consequently, it is desirable to increase the efficiency of the lamp drive circuit, so that power consumption can be reduced without a commensurate reduction in light output from the lamp.

Accordingly, it is an object of this invention to increase the efficiency of electrodeless gas discharge lamp drive circuits by improving the coupling of the magnetic field to the gas fill within the lamp. It is also an object of this invention to reduce the strength of the magnetic field at locations external to the lamp so as to minimize the potential interference of the lamp drive circuit with other electronic circuits.

SUMMARY OF THE INVENTION

In accordance with the present invention there is provided an electrodeless gas discharge lamp assembly that includes a gas discharge lamp having an envelope containing an ionizable gas fill, an inductive drive coil having a number of turns of an electrical conductor wound about the lamp envelope, and a flux concentrator comprising a magnetically permeable material disposed about at least a portion of the drive coil and lamp envelope. The flux concentrator can comprise a tubular sleeve which can have an axial split that extends the length of the sleeve. The sleeve operates to confine the magnetic flux lines to thereby reduce the amount of magnetic field emanating outside the lamp assembly. To reduce eddy current losses, the flux concentrator can be formed from electrically isolated laminations of the magnetically permeable material.

The flux concentrator can include a magnetically permeable end piece that is integrally attached to one end of the sleeve. This helps to further confine the magnetic flux lines at the one end of the sleeve. The flux concentrator can also include a magnetically permeable core piece that is integral with the end piece and that extends into a recessed portion of the lamp envelope. This core piece concentrates the magnetic flux lines through a central portion of the lamp where the plasma discharge is primarily located.

BRIEF DESCRIPTION OF THE DRAWINGS

Preferred exemplary embodiments of the present invention will hereinafter be described in conjunction with the appended drawings, wherein like designations denote like elements, and wherein.

PRIOR ART LAMP ASSEMBLY

Figure 1:
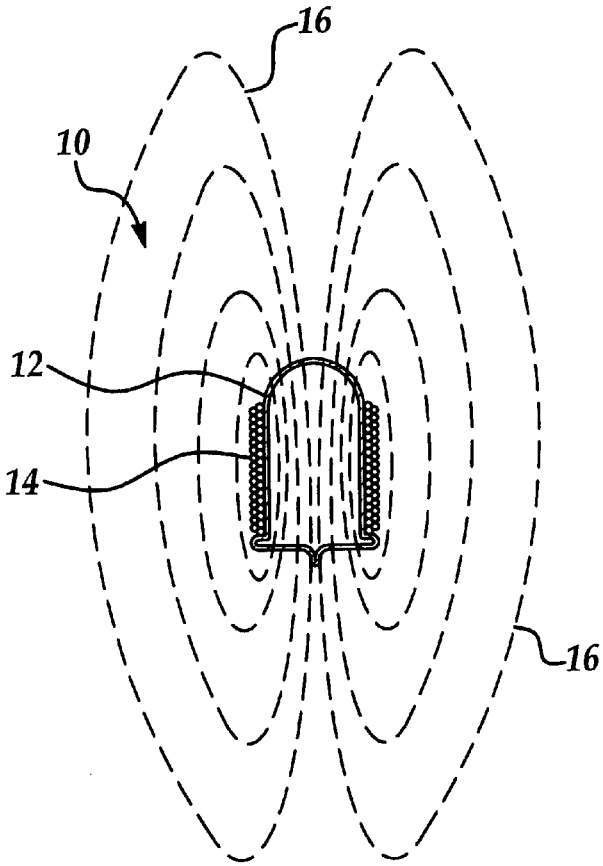
Figure 1 Prior Art
FIG. 1 is a cross-sectional view of a prior art gas discharge lamp and drive coil assembly depicting the magnetic flux lines resulting from current flow through the coil.

FIG. 1 depicts a prior art lamp assembly 10 which includes an electrodeless gas discharge lamp 12 having a low pressure fill of ionizable gas, such as neon, and an inductive drive coil 14 that receives operating power from an a.c. supply (not shown). As is known, energization of drive coil 14 by the a.c. supply produces a time-varying magnetic field which is depicted by the magnetic flux lines 16. As indicated in FIG. 1, these flux lines emanate beyond the confines of the lamp assembly where they can interfere with other electronic and magnetic systems. When used for automotive lighting applications, this magnetic field could potentially interfere with such things as engine sensors or the vehicle electronic compass. Moreover, the illustrated flux lines are diagrammatic only and, as will be understood by one skilled in the art, the magnetic field will actually extend much further away from lamp 12 than as indicated.

DESCRIPTION OF THE PREFERRED EMBODIMENTS

Figure 2:
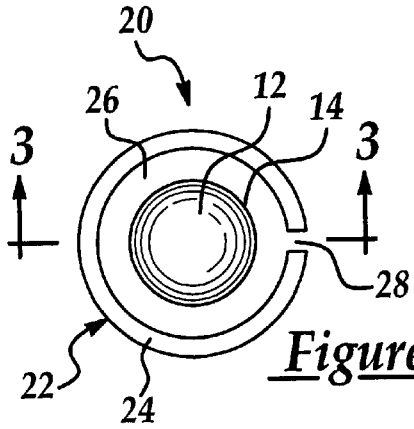
FIG. 2 is a top view of a first embodiment of a lamp assembly of the present invention.
Figure 3:
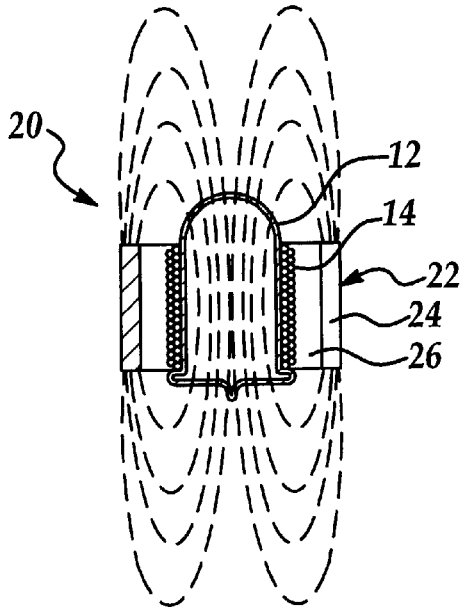
FIG. 3 is a cross-sectional view taken along the 3—3 line of FIG. 2 depicting the affect of the flux concentrator on magnetic flux lines produced by energization of the drive coil.

Referring to FIGS. 2 and 3, there is shown a first embodiment of a lamp assembly 20 of the present invention. Lamp assembly 20 includes an electrodeless gas discharge lamp 12 and drive coil 14 as in FIG. 1, and further includes a flux concentrator 22 in the form of a tubular sleeve 24. Sleeve 24 is constructed of a magnetically permeable material (whether ferromagnetic or paramagnetic), such as iron powder metal or low carbon steel. As shown in FIG. 3, sleeve 24 provides a low reluctance path that serves to confine the magnetic flux lines 16 to an area closely adjacent the lamp assembly. This helps minimize the amount of magnetic field that emanates from the lamp assembly.

In the embodiment illustrated in FIGS. 2 and 3, sleeve 24 is cylindrical in shape and is spaced from coil 14 by a gap 26. This gap prevents possible shorting of the windings by sleeve 24 and helps minimize the effect of sleeve 24 on the inductance of coil 14. As shown in FIG. 3, sleeve 24 is axially coextensive with drive coil 14, although it will be appreciated by those skilled in the art that the length of sleeve 24 and its positioning relative to coil 14 can be selected to provide the desired degree of shaping and confinement of the magnetic field produced by coil 14.

Figure 4:
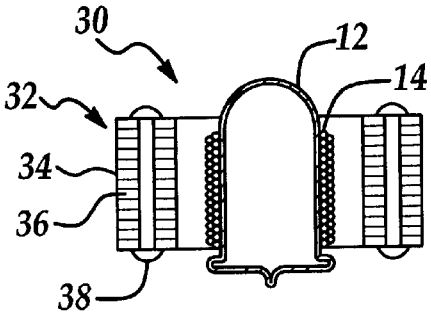
FIG. 4 is a cross-sectional view of a second embodiment of the invention that utilizes laminations of magnetically permeable material.

As is known, electrodeless lamps such as lamp 12 are energized using an a.c. signal at radio frequencies. To prevent circumferentially circulating currents that could otherwise cause losses at these frequencies, sleeve 24 includes an axial split 28 that extends the length of the sleeve. Also, to prevent eddy current losses, sleeve 24 can be made of ferrite or other non-conductive ferromagnetic material. Alternatively, laminations can be used, as in the second embodiment depicted in FIG. 4. This figure shows a lamp assembly 30 that utilizes a flux concentrator 32 in the form of a sleeve 34. This sleeve is similar to that of FIGS. 2 and 3 except that it is formed as an axially-extending stack of annular laminations 36. These laminations each comprise a magnetically permeable material that is coated on at least one side with a non-conductive material. A number of suitable non-ferromagnetic fasteners 38 can be used to clamp the laminations 36 together. Sleeve 34 can include an axial split (not shown) as in the first embodiment. Also, the laminations can be oriented other than as shown such that they can be stacked, for example, either radially (as in coaxial laminations) or angularly (as in sectored laminations).

Figure 5:
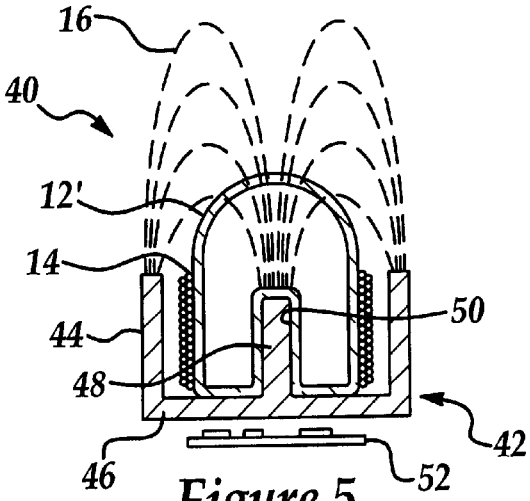
FIG. 5 is a cross-sectional view of a third embodiment of the invention that operates to concentrate magnetic flux lines within the gas discharge lamp envelope.

Referring now to FIG. 5, a third embodiment is shown. This embodiment comprises a lamp assembly 40 which includes a lamp 12', drive coil 14, and a flux concentrator 42 in the form of a sleeve 44, end piece 46, and core piece 48. These three portions of flux concentrator 42 are integrally joined and together they provide a low reluctance path for the magnetic flux lines generated by coil 14. If desired, these three portions can be formed from a single unitary piece of magnetically permeable material. Lamp 12' is similar to that of the other embodiments, except that it has a central recessed portion 50 that is coaxial with drive coil 14. Lamp 12' fits into flux concentrator 42 such that core piece 48 extends into recessed portion 50. As indicated in FIG. 5, this construction concentrates the magnetic field 16 into a solid angle located at a central portion of the lamp where the plasma discharge is primarily located. This is believe to provide better coupling of the magnetic field to the plasma discharge to thereby improve the efficiency of the lamp assembly. In this regard, it will be appreciated that, since the shape and location of the plasma discharge is dependent upon the lamp geometry, the shape and configuration of the flux concentrator can be selected in accordance with the lamp geometry to control the shape, location, and density of the magnetic field passing through the lamp. In this way, the coupling of the magnetic field to the plasma discharge can be maximized to thereby increase the efficiency of the lamp assembly.

Although the core piece 48 helps concentrate the flux lines 16, as described above, it will be appreciated that the use o sleeve 44 and end piece 46 without core piece 48 still provides beneficial effects since these components can be used to shield an underlying a.c. power supply 52. Electrical connections to drive coil 14 can be by way of feedthrough holes in end piece 46. When an electrically conductive material is used for flux concentrator 42, it can be grounded to help reduce radiated r.f. emissions.

Figure 6:
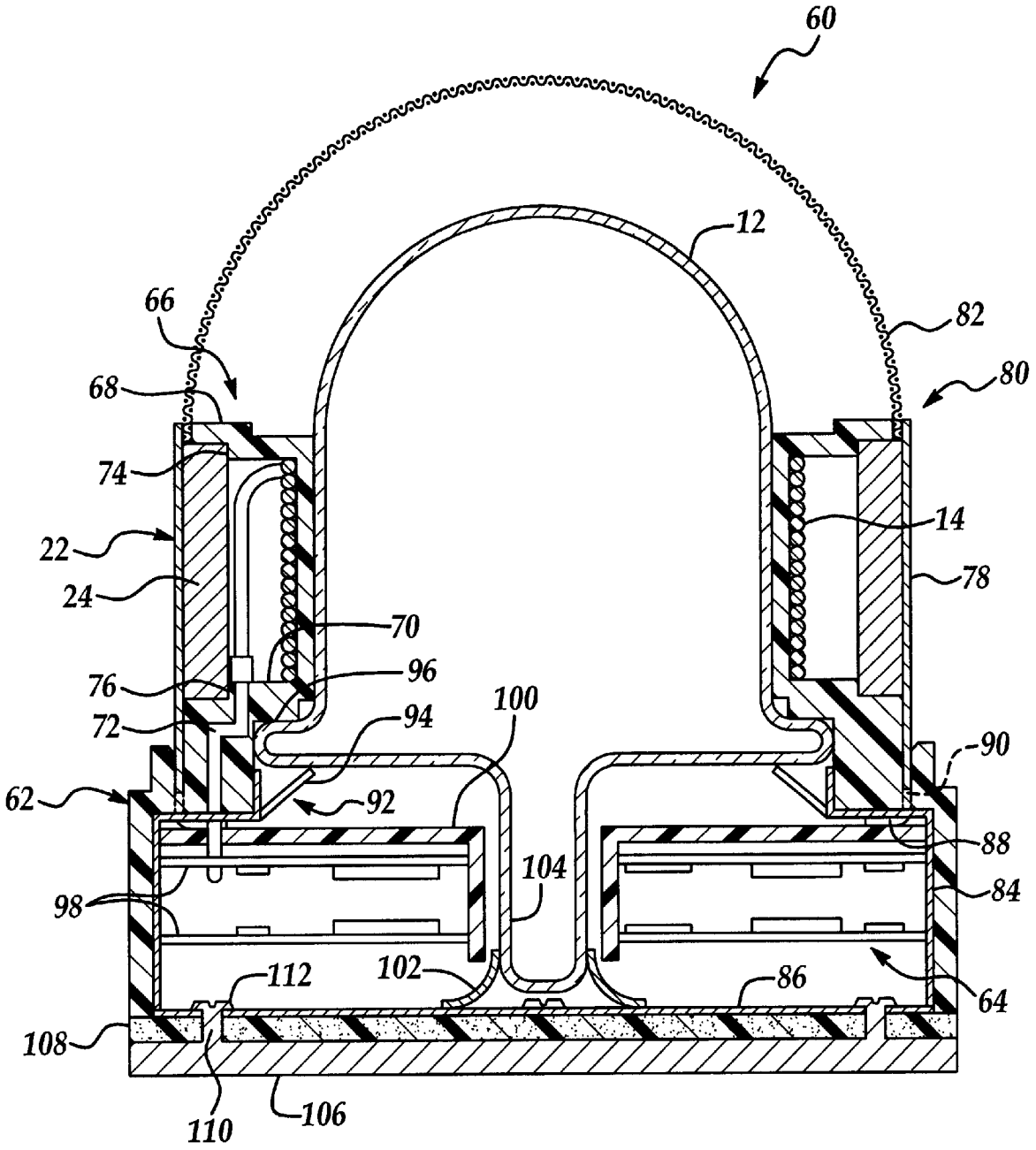
FIG. 6 is a cross-sectional view of an automotive lamp assembly constructed in accordance with the invention.

Turning now to FIG. 6, there is depicted an automotive lamp assembly 60 that includes lamp 12, drive coil 14, and sleeve 24, which is also designated generally as flux concentrator 22. Coil 14 and sleeve 24 are supported by a plastic housing 62 in which lamp 12 is mounted along with a suitable d.c. to a.c. inverter circuit 64, the construction of which is known to those skilled in the art. The upper portion of housing 62 comprises a bobbin 66 on which coil 14 is wound. This bobbin permits coil 14 to be wound prior to assembly of lamp 12 into the housing. Bobbin 66 includes upper and lower annular flanges 68, 70 which limit the axial extent of coil 14. A pair of feedthrough terminals 72 (only one shown) extend from the lower Range 70 of bobbin 66 to the inverter circuit 64. These terminals are used to electrically connect drive coil 14 to inverter circuit 64.

Upper and lower flanges 68, 70 of bobbin 66 include respective opposing shoulders 74, 76 which are used to retain sleeve 24 in a radially spaced position from coil 14. Preferably, sleeve 24 is made from a ferrite material to limit eddy current losses. Sleeve 24 can have a pair of opposed axial splits (not shown) extending the length of the sleeve such that it is in actuality formed from two separate partial cylinders, each having a semi-circular cross-section that extends slightly less than 180°. These separate pieces of sleeve 24 can be retained in place against shoulders 74, 76 by an electrically conductive intermediate shield 78 that is in the form of a circumferentially continuous cylindrical sleeve. Shield 78 is one part of a grounded r.f. shield 80 that also includes an upper hemispherical shield 82, a lower cylindrical shield 84, and a base shield 86. Shield members 78, 82, 84, and 86 are all electrically connected together with either lower shield 84 or base shield 86 being connected to the circuit ground. Upper shield 82 comprises a wire mesh that is selected to provide suitable r.f. shielding without creating a significant reduction in light output from lamp assembly 60. Connection of intermediate shield 78 to lower shield 84 is accomplished by way of a number of angularly spaced tabs 88 that extend down through complementary slots 90 in housing 62 and into electrical contact with lower shield 84. These tabs can then be folded over to retain shield 78 (along with ferrite sleeve 24) in place on housing 62. As will be appreciated, r.f. shield 80 provides a substantially complete enclosure of lamp 12, coil 14, and inverter circuit 64. One location not entirely shielded by this arrangement is at the portions of housing 62 located between tabs 88. To help prevent emission of r.f. interference at these locations, lower shield 84 includes an upstanding collar portion 92 which includes a number of angularly spaced slits. These slits are used to form spaced tabs 94 that, in addition to helping shield against emitted r.f. interference, can be bent inwardly after insertion of lamp 12 into housing 62 to thereby retain lamp 12 in place using a lip 96 of the lamp envelope which contacts the underside of bobbin 66. Rather than forming tabs 94 by slits in collar 92, the collar can simply be deformed inwardly at several locations around its circumference to thereby hold lamp 12 in place.

Inverter circuit 64 is located within the space defined by lower shield 84 and base shield 86 and can be implemented using one or more printed circuit boards 98. The circuit boards can be potted in place after assembly into housing 62. To protect inverter circuit 64 from heat generated by the lamp, a heat shield 100 can be placed between the lamp envelope and circuit boards 98. Additionally, base shield 86 includes a number of angularly spaced metal retaining clips 102 that help centrally locate lamp 12 in housing 62 via a nipple 104 that extends downwardly from the base of lamp 12. These retaining clips also conduct heat from lamp 12 to base shield 86. A heat sink 106 can be provided underneath the bottom plate 108 of housing 62 to remove heat generated by inverter circuit 64 and lamp 12. Heat sink 106 can be retained to housing 62 using a number of protrusions 110 that extend upwardly through bottom plate 108 and base shield 86. These protrusions each have an enlarged head 112 to hold heat sink 106 in place. Preferably, bottom plate 108 is formed of a thermally conductive material to aid in the conduction of heat from base shield 86 to heat sink 106.

D.C. operating power is supplied to circuit boards 98 via terminals (not shown) which extend downwardly through base shield 86, bottom plate 108 and heat sink 106. Three terminals are provided, one connected to circuit ground and the other two for receiving power to operate the lamp at each of two different brightness levels—a lower brightness level for normal taillight operation and a higher brightness level for signaling braking or for turn signal flashing. Preferably, the ground terminal is electrically connected to r.f. shield 80.

It will thus be apparent that there has been provided in accordance with the present invention an electrodeless gas discharge lamp assembly which achieves the aims and advantages specified herein. It will of course be understood that the foregoing description is of preferred exemplary embodiments of the invention and that the invention is not limited to the specific embodiments shown. Various changes and modifications will become apparent to those skilled in the art and all such variations and modifications are intended to come within the scope of the appended claims.

I claim:

1. An inductively driven gas discharge lamp assembly, comprising:

a gas discharge lamp having a sealed envelope containing an ionizable gas fill; and an inductive drive coil having a number of turns of an electrical conductor wound about said envelope, whereby alternating current flowing through said drive coil produces an alternating magnetic field having flux lines that extend through said envelope and said gas fill;

wherein the improvement comprises a flux concentrator disposed about at least a portion of said drive coil and said envelope, said flux concentrator comprising a tubular sleeve formed by laminations of magnetically permeable material with each of said laminations being electrically isolated from each other.

2. A discharge lamp assembly as defined in claim 1, wherein said laminations comprise a stack of annular pieces of said magnetically permeable material with said annular pieces being separated by at least one layer of non-conductive material.

3. A discharge lamp assembly as defined in claim 2, wherein each of said annular pieces includes a non-conductive coating on at least one side thereof and wherein said non-conductive coatings comprise said layers of non-conductive material.

4. An inductively driven gas discharge lamp assembly, comprising:

a gas discharge lamp having a sealed envelope containing an ionizable gas fill; and an inductive drive coil having a number of turns of an electrical conductor wound about said envelope, whereby alternating current flowing through said drive coil produces an alternating magnetic field having flux lines that extend through said envelope and said gas fill;

wherein the improvement comprises a flux concentrator disposed about at least a portion of said drive coil and said envelope, said flux concentrator comprising a tubular sleeve of magnetically permeable material and an end piece of said magnetically permeable material that is integral with said tubular sleeve at one end of said sleeve; and wherein said envelope has a recessed portion extending in the axial direction of said drive coil and wherein said flux concentrator further comprises a core piece of said magnetically permeable material that is integral with said end piece and that extends into said recessed portion of said envelope, whereby at least a portion of said envelope extends between said drive coil and said core piece.

5. A discharge lamp assembly as defined in claim 4, wherein said core piece is unitary with said end portion.

6. A discharge lamp assembly as defined in claim 4, further comprising a d.c. to a.c. inverter circuit for providing operating power to said drive coil, said inverter circuit having at least two inputs with one of said inputs being a ground node, wherein said sleeve comprises an electrically conductive material that is electrically coupled to said ground node.

* * * * *

UNITED STATES PATENT AND TRADEMARK OFFICE

CERTIFICATE OF CORRECTION

PATENT NO. : 6,380,680 B1
DATED : April 30, 2002
INVENTOR(S) : John E. Troxler

It is certified that error appears in the above-identified patent and that said Letters Patent is hereby corrected as shown below:

Title page,
Item [57], ABSTRACT,
Line 12, after "drive coil and" delete "c" and insert therefor -- can also --.

Column 3,
Line 56, after "that the use" delete "o" and insert therefor -- of --.

Column 4,
Line 8, after "from the lower" delete "range" and insert therefor -- flange --.

Signed and Sealed this

Fourth Day of February, 2003

JAMES E. ROGAN
*Director of the United States Patent and Trademark Office*